US008850639B2

(12) United States Patent
Wiggins

(10) Patent No.: US 8,850,639 B2
(45) Date of Patent: Oct. 7, 2014

(54) SIDERAIL LATCHING MECHANISM

(75) Inventor: Brian T. Wiggins, Burlington, KY (US)

(73) Assignee: Hill-Rom Services, Inc., Batesville, IN (US)

( * ) Notice: Subject to any disclaimer, the term of this patent is extended or adjusted under 35 U.S.C. 154(b) by 570 days.

(21) Appl. No.: 12/892,967

(22) Filed: Sep. 29, 2010

(65) Prior Publication Data

US 2012/0073047 A1 Mar. 29, 2012

(51) Int. Cl.
*A47C 21/08* (2006.01)
*A61G 7/05* (2006.01)

(52) U.S. Cl.
CPC ..... *A61G 7/0507* (2013.01); *A61G 2007/0509* (2013.01)
USPC ..... 5/428; 5/424; 5/425; 5/426; 5/427; 5/430

(58) Field of Classification Search
CPC ..... A61G 7/0507; A61G 2007/0509; A61G 2007/0514; A61G 2007/0513; A61G 7/005; A61M 2209/082; A61M 5/1415
USPC ..... 5/424–430
See application file for complete search history.

(56) References Cited

U.S. PATENT DOCUMENTS 4,653,129 A * 3/1987 Kuck et al. ..... 5/430
5,173,975 A * 12/1992 Peterson ..... 5/430
5,732,423 A * 3/1998 Weismiller et al. ..... 5/425
6,253,397 B1 * 7/2001 Bartow et al. ..... 5/430
6,658,680 B2 * 12/2003 Osborne et al. ..... 5/600
6,779,209 B2 * 8/2004 Ganance ..... 5/430
7,073,220 B2 * 7/2006 Simmonds et al. ..... 5/428
7,082,630 B2 * 8/2006 Castonguay et al. ..... 5/430
7,107,637 B2 * 9/2006 Kuek et al. ..... 5/430
7,761,939 B2 * 7/2010 Wiggins et al. ..... 5/430

FOREIGN PATENT DOCUMENTS

WO 0147340 A2 4/2001
WO 2004087030 A1 10/2004

OTHER PUBLICATIONS

European Search Report; Application No. EP11183140; Place of Search—The Hague; Date of Completion of The Search—Aug. 2, 2012.

* cited by examiner

*Primary Examiner* — William Kelleher
*Assistant Examiner* — Duoni Pan
(74) *Attorney, Agent, or Firm* — Jason Penninger

(57) ABSTRACT

A latch mechanism for a siderail assembly comprises a handle, a link assembly, and a pin. The handle is configured to be moved between a first position and a second position. The link assembly is coupled to the handle and configured to move between a latch position and an unlatch position as a function of the movement of the handle. The pin is configured to be engaged by the link assembly and is configured to rotate from a first rotational orientation to a second rotational orientation to disengage the link assembly from the pin when a false latching condition occurs.

19 Claims, 9 Drawing Sheets

SIDERAIL LATCHING MECHANISM

BACKGROUND OF THE DISCLOSURE

This disclosure relates generally to siderail assemblies attached to person-support apparatuses. More particularly, but not exclusively, one illustrative embodiment relates to a siderail assembly with a latching mechanism configured to prevent false latching conditions.

Generally, a person-support apparatus can include a siderail that can be configured to move between a deployed position and a storage position. The siderail can be selectively maintained in the positions by a latching mechanism. While various siderails and latching mechanisms have been developed, there is still room for improvement. Thus a need persists for further contributions in this area of technology.

SUMMARY OF THE DISCLOSURE

The present disclosure includes one or more of the features recited in the appended claims and/or the following features which, alone or in any combination, may comprise patentable subject matter.

One illustrative embodiment of the present disclosure can include a latching mechanism for a siderail with a link assembly and a pin configured to rotate with respect to the link assembly when a false latching condition occurs to disengage the link assembly from the pin.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
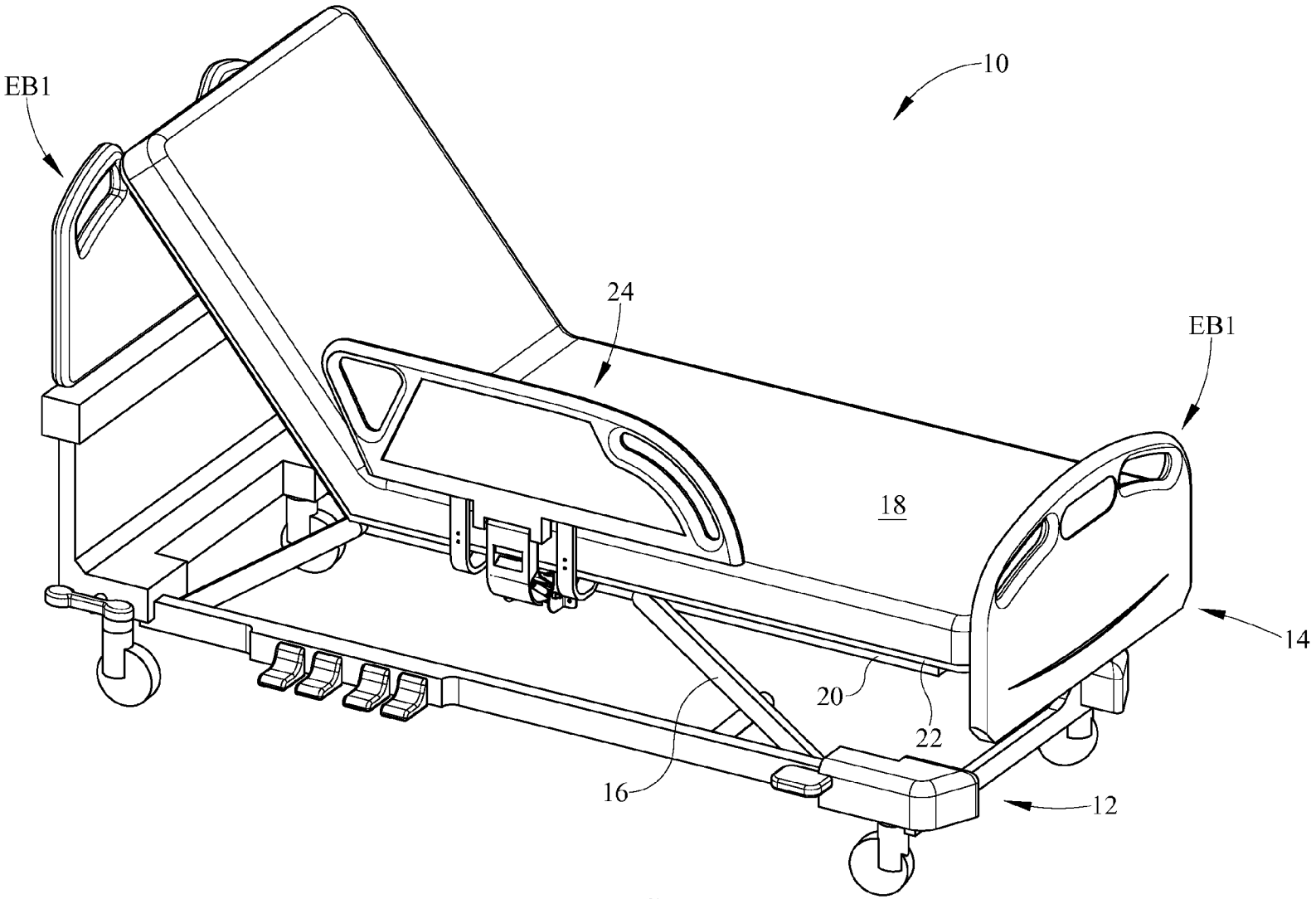
FIG. 1 is a perspective side view of a person-support apparatus with a siderail assembly coupled thereto according to one illustrative embodiment of the disclosure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

One illustrative embodiment of the present disclosure can include a latching mechanism for a siderail with a link assembly and a pin configured to rotate with respect to the link assembly when a false latching condition occurs to disengage the link assembly from the pin.

A person-support apparatus 10 according to one illustrative embodiment of the current disclosure is shown in FIG. 1. The person-support apparatus 10 can be a hospital bed and can include a lower frame 12 or base 12 and an upper frame 14 supported on a plurality of supports 16 above the lower frame 12. It should be appreciated that the person-support apparatus 10 can also be a hospital stretcher, an operating table, or other apparatus configured to support a person thereon. It should also be appreciated that the supports 16 can be lift mechanisms configured to move the upper frame 14 with respect to the lower frame 12. It should also be appreciated that, in one illustrative embodiment, the person-support apparatus 10 can support a person-support surface 18 or mattress 18 on the upper frame 14.

The upper frame 14 can include an upper frame base 20 and a deck 22 and can have a siderail assembly 24 coupled thereto as shown in FIG. 1. It should be appreciated that the siderail assembly 24 can be present on both sides of the person-support apparatus 10. It should also be appreciated that the upper frame 14 can also have endboards EB1 coupled thereto. The deck 22 can be supported on the upper frame base 20 and can include multiple sections that can be configured to pivot and/or translate with respect to the upper frame base 20 and one another.

Figure 2:
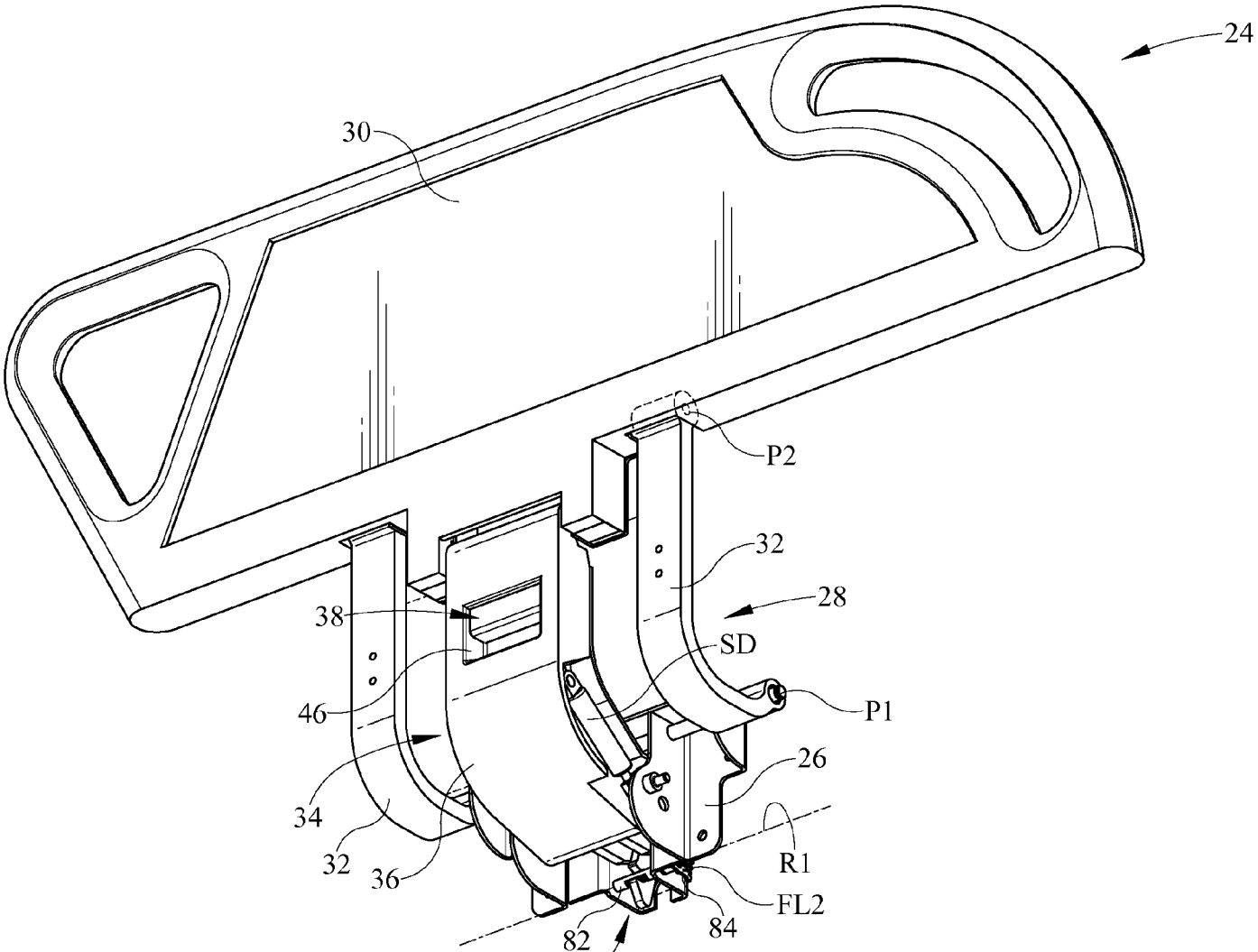
FIG. 2 is a perspective side view of the siderail assembly of FIG. 1 showing the siderail body, the movement mechanism, and the siderail base.

The siderail assembly 24 can include a base 26, a movement assembly 28, and a siderail body 30 as shown in FIGS. 1-2. The base 26 can be configured to couple the movement assembly 28 and siderail body 30 to the upper frame 14. In one illustrative embodiment, the base 26 can be coupled to the upper frame base 20. It should be appreciated that the base 26 can be coupled to one of the sections of the deck 22.

The movement assembly 28 can be movably coupled to the base 26 and the siderail body 30 and can be configured to selectively move the siderail body 30 between a deployed position and a storage position with respect to the upper frame 14. The movement assembly 28 can include a pair of link arms 32 and a latch mechanism 34 as shown in FIGS. 1-2. It should be appreciated that the movement assembly 28 can also include a dampener SD, such as, a spring dampener, coupled to the base 26 and the latch mechanism 34 and configured to slow the movement of the siderail body 30 as the siderail body 30 is moved between the deployed position and the storage position. The link arms 32 can be movably coupled to the base 26 at a first pivot P1 and movably coupled to the siderail body assembly 30 at a second pivot P2.

The latch mechanism 34 can be configured to prevent the link arms 32 and the latch mechanism 34 from moving with respect to the upper frame 14 to maintain the orientation of the siderail body 30 with respect to the upper frame 14. The latch mechanism 34 can include a housing 36, a handle 38, a link assembly 40, and a pin assembly 42 as shown in FIGS. 2-8. The housing 36 can be movably coupled to the base 26 at a third pivot P3 and movably coupled to the siderail body 30 at a fourth pivot P4. The housing 36 can include an inner space 44 and an opening 46 into the inner space 36. In one illustrative embodiment, the handle 38 and the link assembly 40 can be positioned within the inner space 44. It should be appreciated that the pin assembly 42 can also be positioned within the inner space 44. The opening 46 can be configured to provide access the handle 38.

Figure 3:
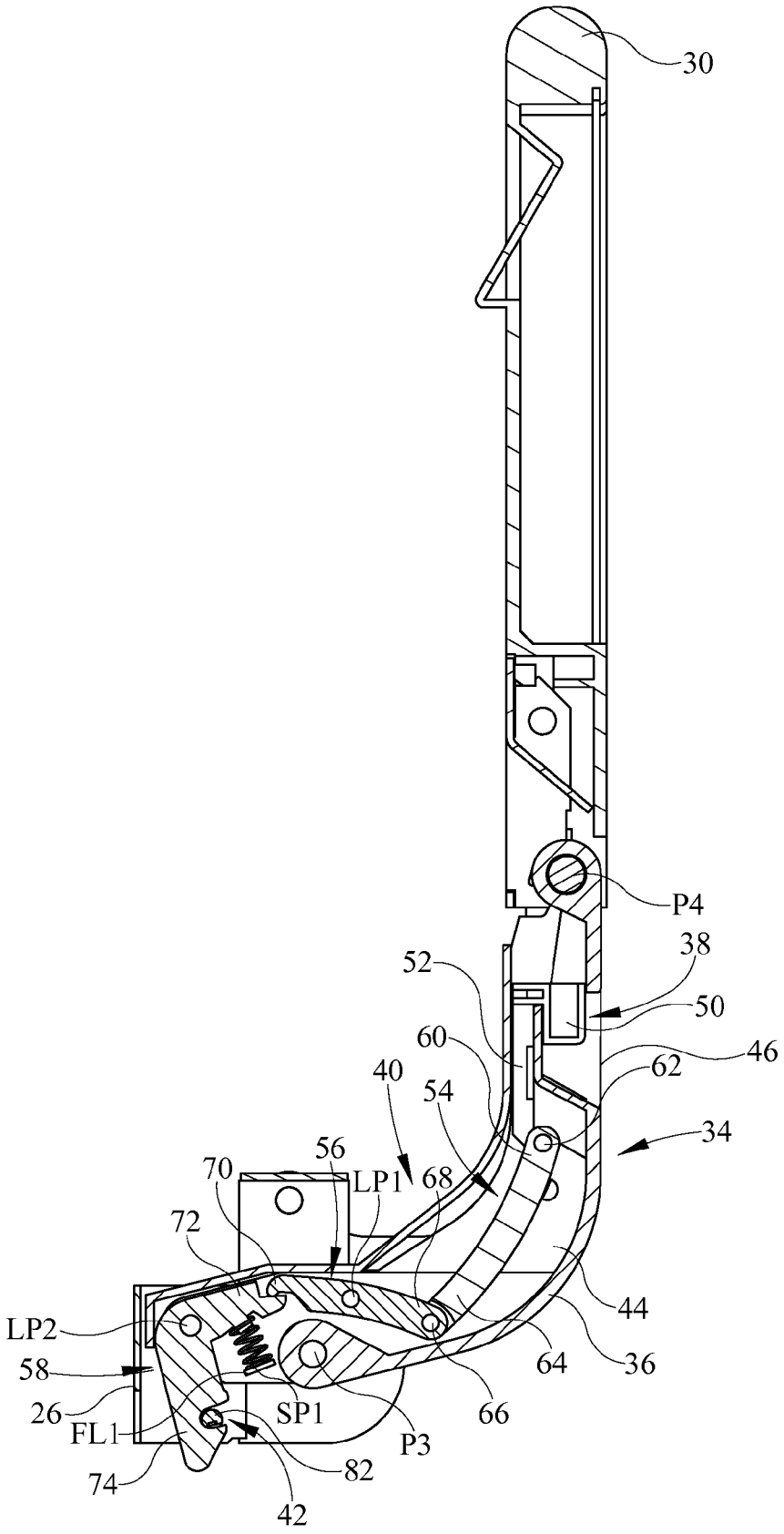
FIG. 3 is a cross-sectional side view of the siderail assembly of FIG. 1 showing the housing, the handle, the link assembly, and the pin of the latch mechanism.

The handle 38 can be positioned in the inner space 44 proximate to the opening 46 and can be moved between a first position and a second position with respect to the housing 36. In one illustrative embodiment, the handle 38 can be in the first position when the link arms 32 and the latch mechanism 34 are prevented from moving with respect to the upper frame 14 and can be in the second position when the link arms 32 and the latch mechanism 34 are allowed to move with respect to the upper frame 14. The handle 38 can include a grip 50 and an extension member 52 as shown in FIGS. 2-3. The grip 50 can be located proximate to the opening 46 and the extension member 52 can extend from the grip 50 and be coupled to the link assembly 40.

The link assembly 40 can be coupled to the handle 38 and can be configured to engage the pin assembly 42 to selectively prevent the link arms 32 from moving with respect to the upper frame 14 as shown in FIGS. 3-8. The link assembly 40 can include a first link 54, a second link 56, and a third link 58. The first link 54 can include a first end 60 that can be coupled to the extension member 52 at a first link joint 62 and a second end 64 that can be coupled to the second link 42 at a second link joint 66. The first link 48 can be configured to move with the handle 38 as the handle 38 moves between the first position and the second position.

The second link 56 can be rotatably coupled to the housing 36 at a first link pivot LP1 as shown in FIGS. 3-8. The second link 56 can include a first end 68 that can be coupled to the first link 54 at the second link joint 66 and a second end 70 that can be configured to engage the third link 58. It should be appreciated that the first link pivot LP1 can be located between the first end 68 and the second end 70 of the second link 56. The second link 56 can be configured to rotate about the first link pivot LP1 as the handle 38 is moved between the first position and the second position. In one illustrative embodiment, the second link 56 can rotate counter-clockwise about the first link pivot LP1 when the grip 38 is moved from the first position to the second position.

The third link 58 can be rotatably coupled to the housing 36 at a second link pivot LP2 as shown in FIGS. 3-8. The third link 58 can include a first end 72 that can be configured to engage the second link 56 and a second end 74 or pin engaging end 74 that can be configured to engage the pin assembly 42. The third link 58 can be configured to rotate about the second link pivot LP2 between a first rotational orientation or latched position and a second rotational orientation or an unlatched position as the handle 38 is moved between the first position and the second position. In one illustrative embodiment, the third link 58 can rotate clockwise from the latched position to the unlatched position about the second link pivot LP2 when the grip 38 is moved from the first position to the second position. The third link 58 can be biased toward the first rotational orientation or latched position by a first spring SP1 positioned between the third link 58 and a first flange FL1 extending from the housing 36. In one illustrative embodiment, the first spring SP1 can engage the third link 58 between the second link pivot LP2 and the first end 72. It should be appreciated that the first spring SP1 can cause the handle 38 to return to the first position from the second position.

Figure 5:
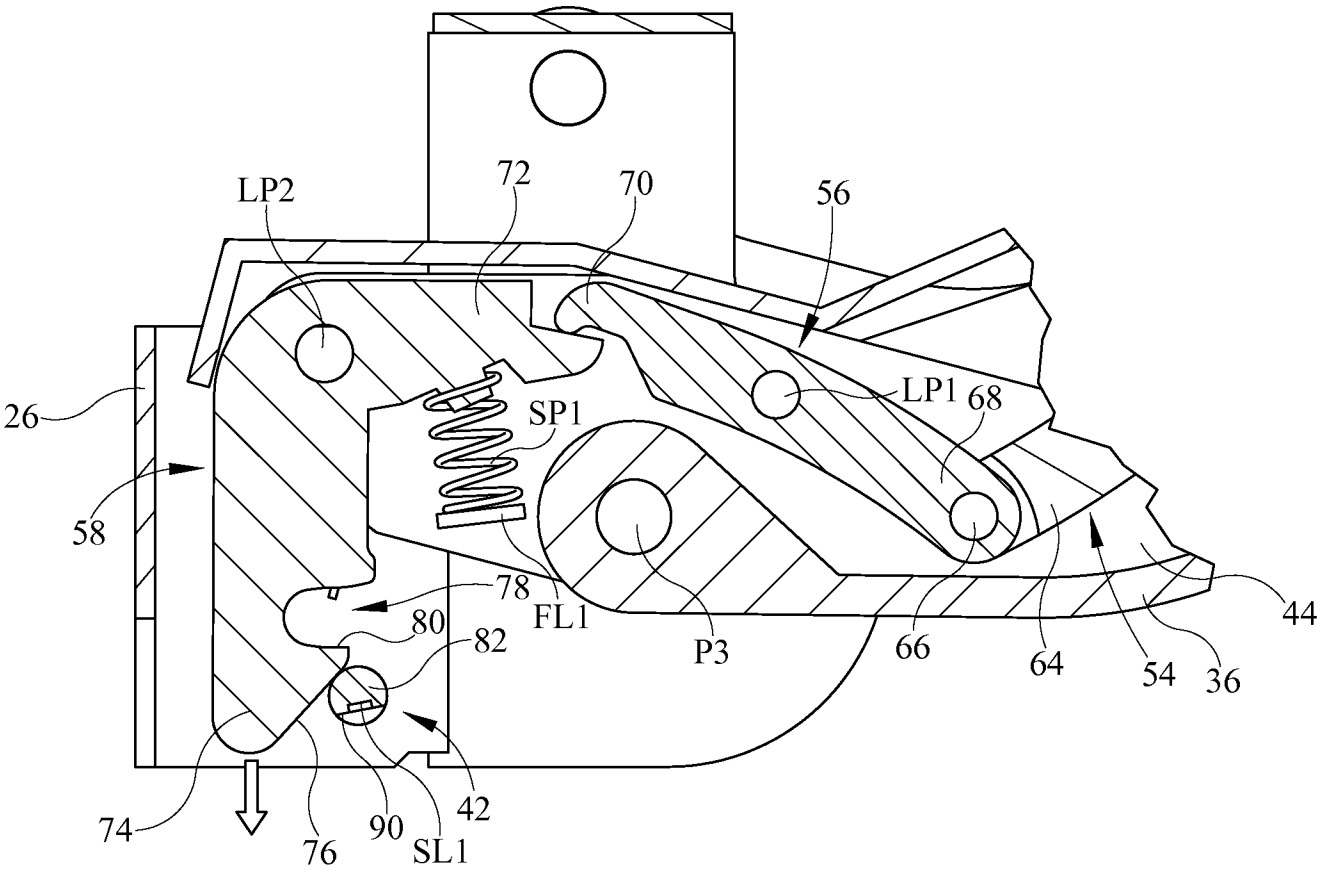
FIG. 5 is a cross-sectional side view of the latch mechanism of FIG. 3 with the link assembly moving toward engagement of the pin.

The pin engaging end 74 can be configured to engage the pin assembly 42 in the latched position to prevent the link arms 32 and the latch mechanism 34 from moving with respect to the upper frame 14. In one illustrative embodiment, the pin engaging end 74 can be shaped like a hook and can include a first pin engaging surface 76 and a slot 78 with a second pin engaging surface 80. The first pin engaging surface 76 can be an angled surface configured to engage the pin assembly 42 as the third link 58 moves toward the latched position as shown in FIG. 5. In one illustrative embodiment, the third link 58 can be rotated about the second link pivot LP2 and can compress the first spring SP1 as the pin assembly 42 moves along the first pin engaging surface 76. Once the pin assembly 42 reaches the end of the first pin engaging surface 76, the pin assembly 42 engages the second pin engaging surface 80 as the pin assembly 42 moves into the slot 78 to define the latched position. It should be appreciated that the second pin engaging surface 80 can be flat.

Figure 6:
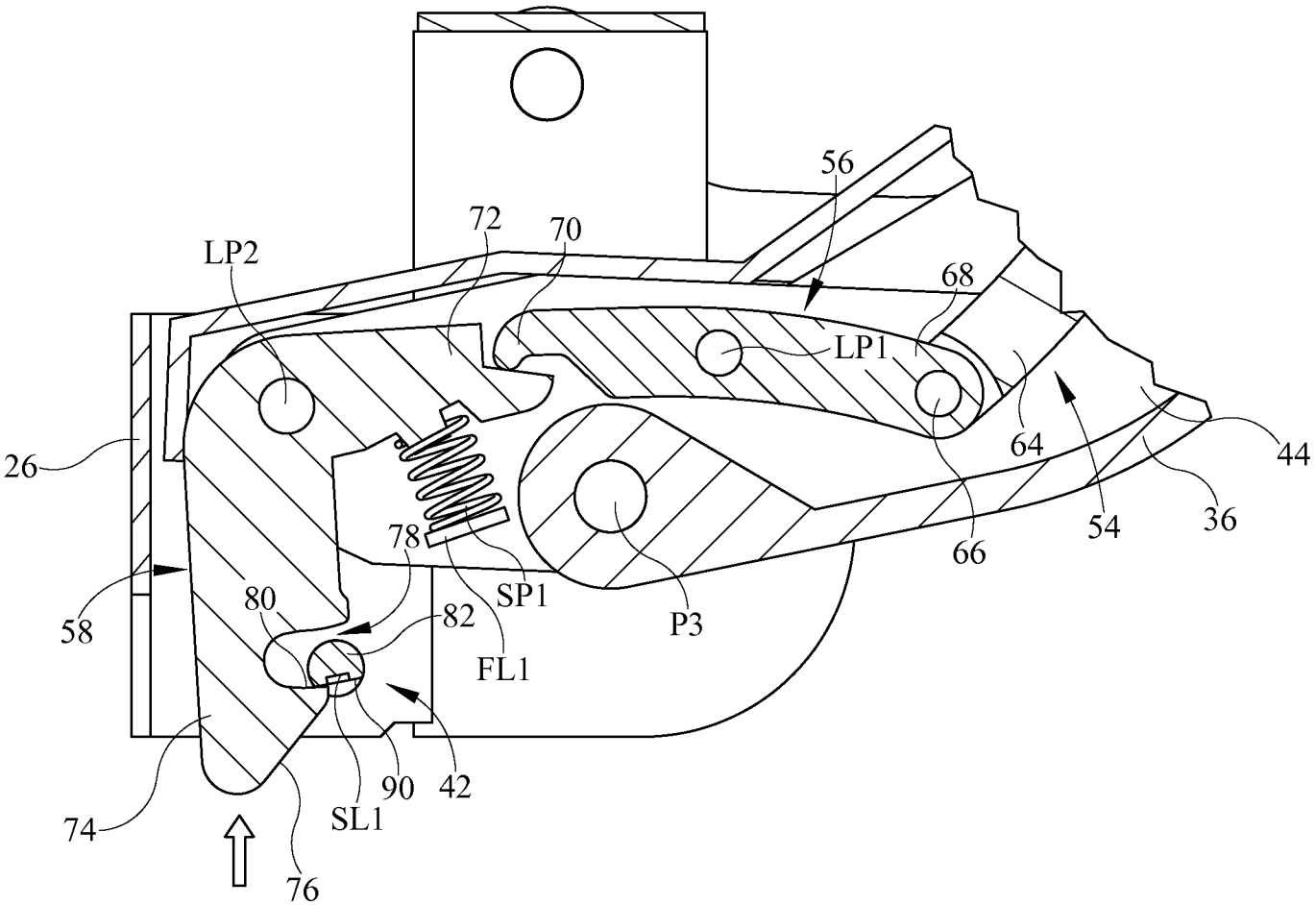
FIG. 6 is a cross-sectional side view of the latch mechanism of FIG. 3 with the link assembly partially engaging the pin such that a false latch condition might result.
Figure 8:
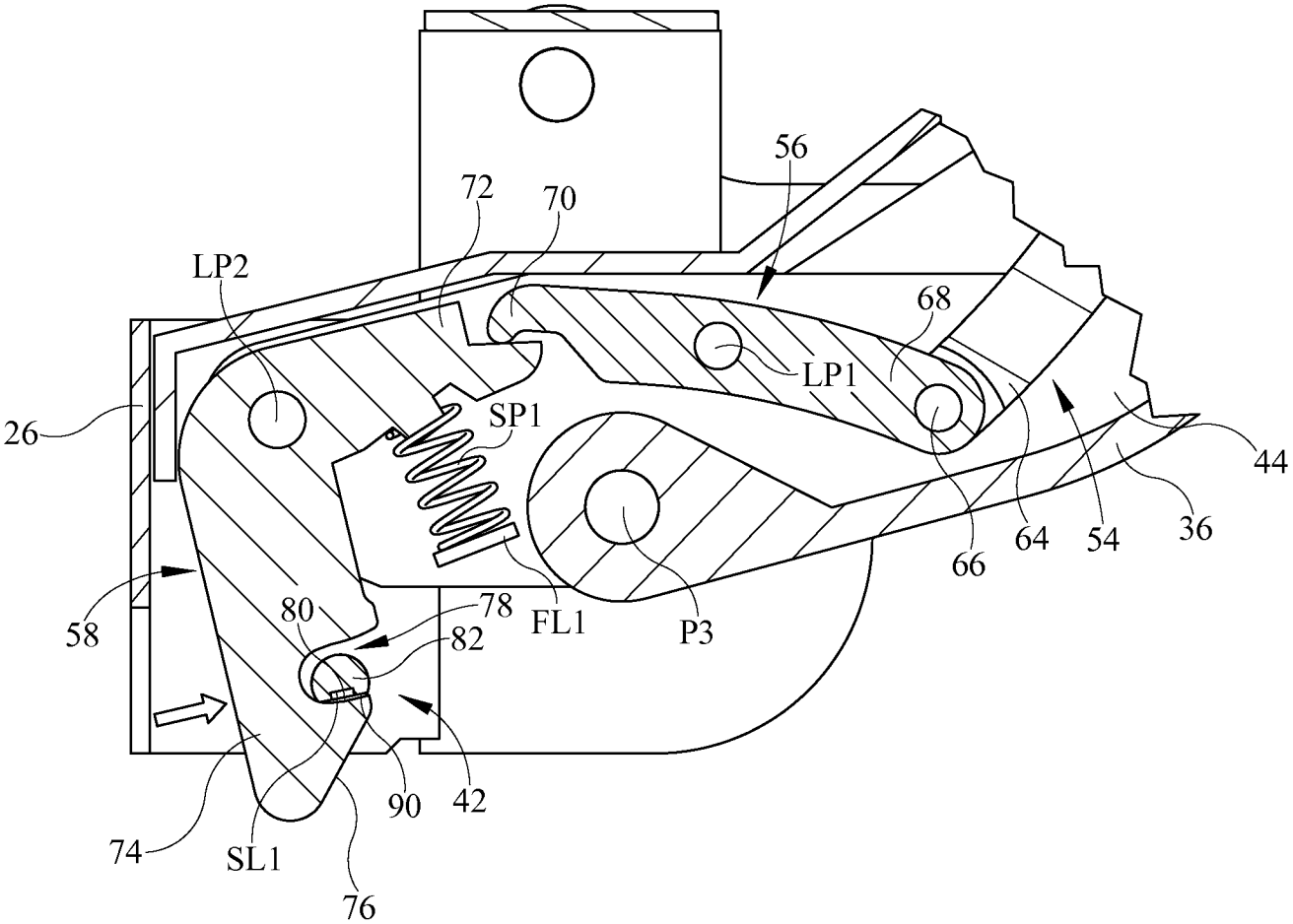
FIG. 8 is a cross-sectional side view of the latch mechanism of FIG. 3 with the link assembly substantially engaging the pin such that a latch condition results.
Figure 9:
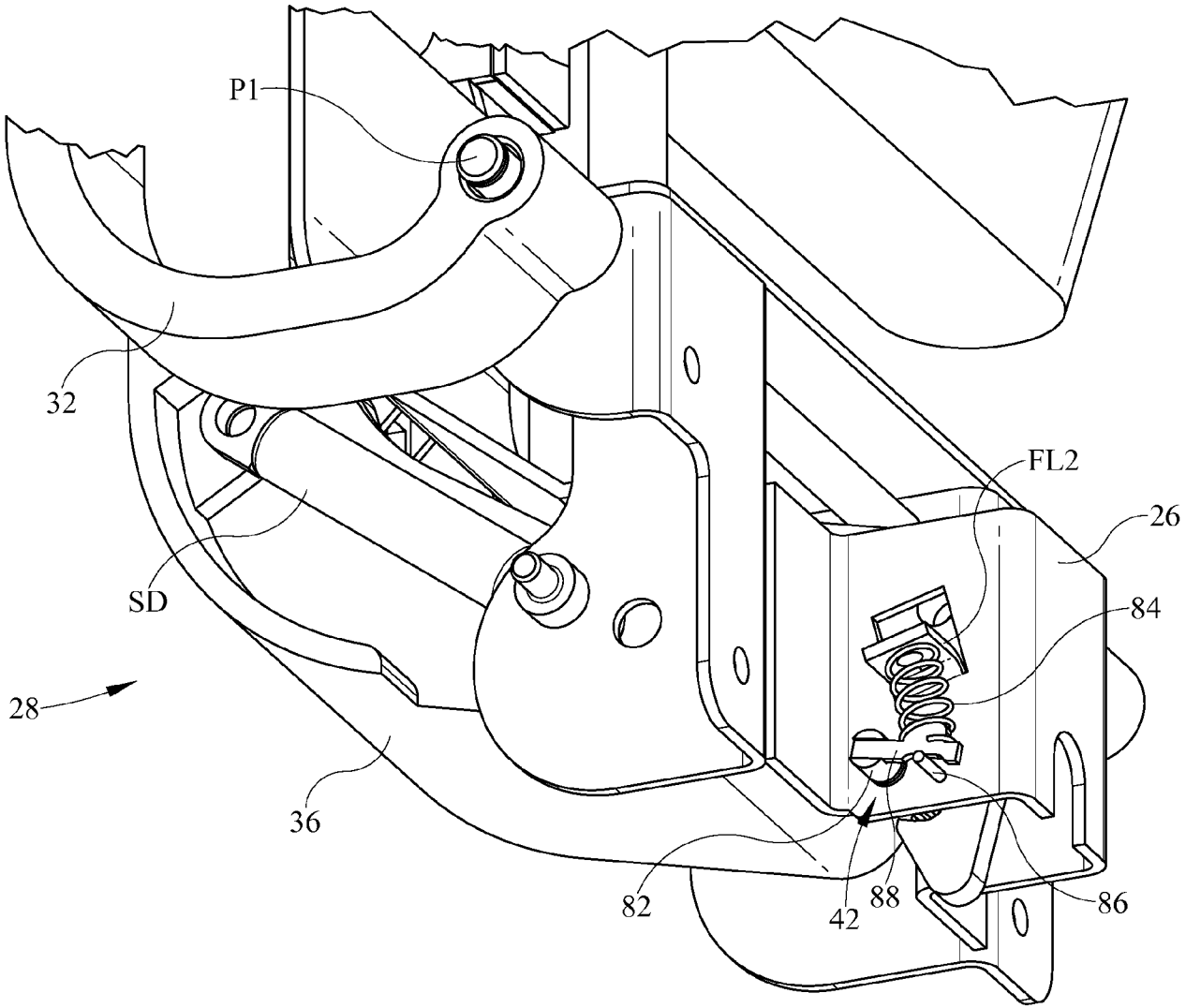
FIG. 9 is a perspective side view of the latch mechanism of FIG. 3 showing the rotation limiting member, the stop, and the second spring of the pin assembly.

The pin assembly 42 can be coupled to the base 26 and can be configured to cooperate with the base 26 and the pin engaging end 74 to prevent a false latching condition. A false latching condition can occur when an external force is applied to a siderail, i.e., a person leaning on the siderail, maintained in the deployed position, which causes the assembly maintaining the siderail in the deployed position to disengage and allow the siderail to move from the deployed position to the storage position. In one illustrative embodiment, a false latch condition might occur when the third link 58 partially engages the pin assembly 42 as shown in FIG. 6. False latching conditions can be prevented by fully latching the assembly maintaining the siderail in the deployed position. In one illustrative embodiment, the latch mechanism 34 can be fully latched when the pin assembly 42 is substantially engaged by the third link 58 as shown in FIG. 8. In some instances, an audible "click" can be heard when the latch mechanism 34 is fully latched, which can result from the portion of the pin assembly 42 engaged by the pin engaging end 74 of the third link 58 contacting the base of the slot 78 in the pin engaging end 74.

The pin assembly 42 can include a shaft 82, a second spring 84, a stop 86, and a rotation limiting member 88 as shown in FIGS. 2-9. The shaft 82 can be rotatably coupled to the base 26 and configured to rotate about a first rotational axis R1 between a first orientation and a second orientation with respect to the base 26 to prevent a false latching condition from occurring. In one illustrative embodiment, the shaft 82 can include a link engaging portion or D-shaped portion with a flat link engaging surface 90 configured to engage the pin engaging end 74 of the third link 58. It should be appreciated that the link engaging portion can have a curved link engaging surface (not shown). In one illustrative embodiment, the link engaging portion can include a groove SL1 that can extend along the length of the flat link engaging surface 90 in about the center of the flat link engaging surface 90 and can be configured to allow the shaft 82 to rotate unless the second pin engaging surface 80 spans the groove SL1 and engages both portions of the flat link engaging surface 90. The rotation limiting member 88 can be coupled to the end of the shaft 82 and can be configured to engage the stop 86 to define the first orientation of the shaft and configured to cooperate with the second spring 84 to return the shaft from the second orientation to the first orientation when the shaft 82 is not engaged by the pin engaging end 74 of the third link 58. The second spring 84 can engage a second flange FL2 on the base 26 and the rotation limiting member 88 and can be configured to be compressed from a first length to a second length when the shaft 82 rotates from the first orientation to the second orientation, and configured to expand from the second length to the first length to cause the rotation limiting member 88 to rotate the shaft 82 from the second orientation to the first orientation.

Figure 4:
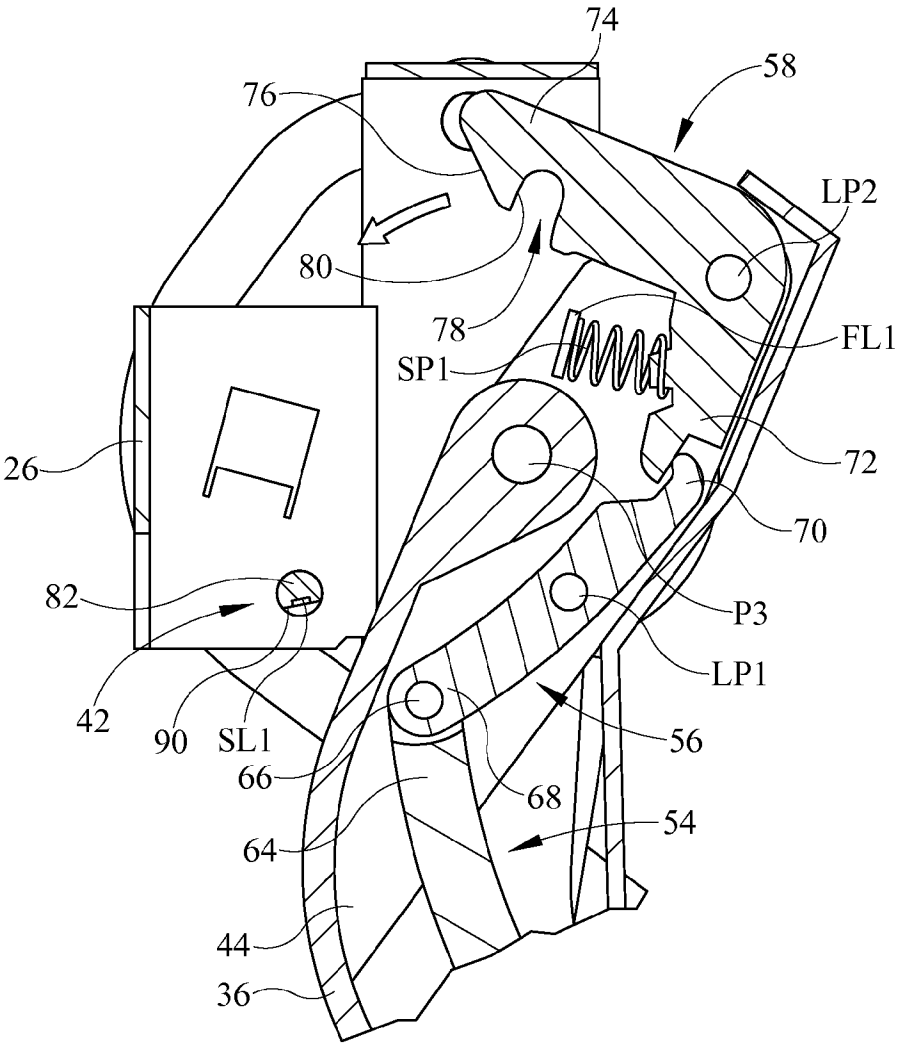
FIG. 4 is a cross-sectional side view of the latch mechanism of FIG. 3 with the link assembly disengaged from the pin.
Figure 7:
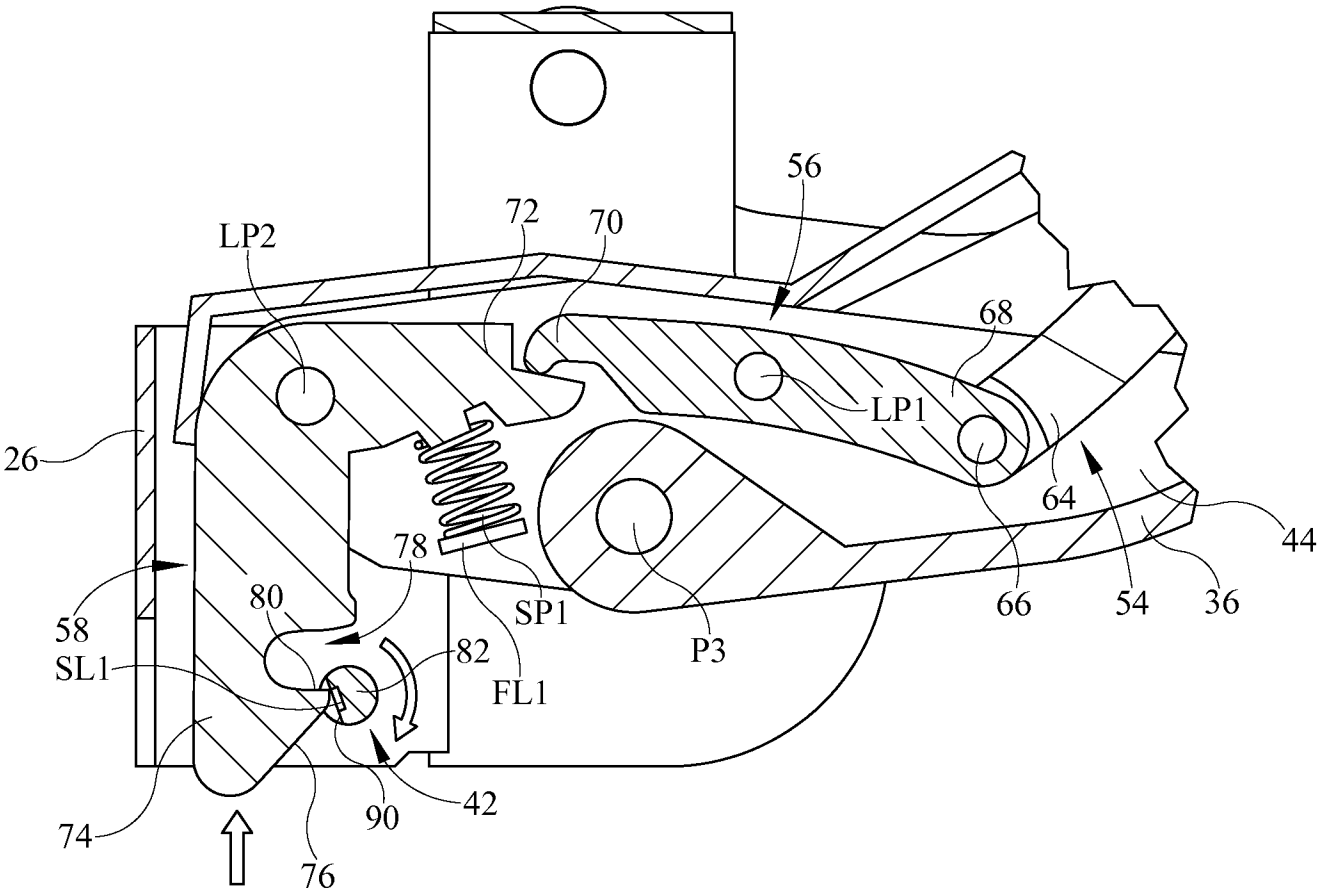
FIG. 7 is a cross-sectional side view of the latch mechanism of FIG. 3 showing the pin rotating to disengage the link assembly from the pin to prevent the false latching condition.

In operation, the siderail body 30 can be in the stored position and the third link 58 can be in the unlatched position as shown in FIG. 4. As the siderail body 30 is moved from the storage position toward the deployed position, the pin engaging end 74 of the third link 58 can be moved toward the shaft 80 of the pin assembly 42. As the siderail body 30 is positioned in the deployed position, the shaft 82 of the pin assembly 42 can engage the first pin engaging surface 76 and move along the first pin engaging surface 76 toward the slot 78. When the siderail body 30 is positioned in the deployed position, the shaft 82 can be received in the slot 80 and the second pin engaging surface 80 can engage the link engaging surface 86. If the second pin engaging surface 80 only partially engages the link engaging surface 86, as shown in FIG. 6, the weight of the siderail body 30 can cause the shaft 82 to rotate from the first orientation to the second orientation and disengage the pin engaging end 74 from the shaft 82 as shown in FIG. 7. If the second pin engaging surface 80 substantially engages the link engaging surface 86, as shown in FIG. 8, the shaft 80 will not rotate and the siderail body 30 will be maintained in the deployed position. In one illustrative embodiment, the second pin engaging surface 80 substantially engages the link engaging surface 86 when the second pin engaging surface is substantially tangential to the radius of curvature of the shaft 82. In another illustrative embodiment, the second pin engaging surface 80 substantially engages the link engaging surface 86 when the second pin engaging surface engages greater than about half of the width of the link engaging surface 86. In another illustrative embodiment, the shaft 82 is substantially engaged when at least 50% of the cross-sectional area of the shaft 82 is positioned in the slot 78. It should be appreciated that where the flat link engaging surface 90 includes the groove, greater than 50% of the width of the flat link engaging surface 90 must be engaged to prevent the shaft 82 from rotating.

Many other embodiments of the present disclosure are also envisioned. For example, a latch mechanism for a siderail assembly comprises a handle, a link assembly, and a pin. The handle is configured to be moved between a first position and a second position. The link assembly is coupled to the handle and configured to move between a latch position and an unlatch position as a function of the movement of the handle. The pin is configured to be engaged by the link assembly and is configured to rotate from a first rotational orientation to a second rotational orientation to disengage the link assembly from the pin when a false latching condition occurs.

In another example, the siderail assembly comprises a siderail base, a siderail body, and a movement mechanism. The siderail base is configured to be coupled to a frame. The movement mechanism is coupled to the siderail base and the siderail body and is configured to move the siderail body between a first position and a second position. The movement mechanism includes a latch mechanism configured to maintain the siderail body in at least one of the first position and the second position. The latch mechanism includes a latch pin configured to move with respect to the siderail base to prevent a false latch condition.

In yet another example, a person-support apparatus comprises a frame and a siderail. The siderail is coupled to the frame. The siderail is configured to move between a deployed position and a storage position with respect to the frame. The siderail is selectively maintained in at least one of the deployed position and the storage position by a latch mechanism. The latch mechanism includes a latch pin and a pin engaging member. The pin engaging member is configured to engage the latch pin to selectively maintain the siderail in at least one of the deployed position and the storage position. The latch pin is configured to rotate from a first orientation to a second orientation when the pin engaging member does not substantially engage the latch pin.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. A siderail assembly, comprising:

a siderail base configured to couple the siderail assembly to a frame;

a siderail body; and a movement mechanism coupled to the siderail base and the siderail body and configured to move the siderail body with respect to the siderail base, the movement mechanism including a latch mechanism configured to selectively maintain the position of the siderail body with respect to the siderail base, the latch mechanism including a latch pin configured to rotate with respect to the siderail base from a first orientation to a second orientation to prevent a false latch condition.

2. The siderail assembly of claim 1, wherein the latch mechanism includes a link configured to engage the latch pin, the latch pin moving with respect to the siderail base to disengage the link from the latch pin to prevent a false latch condition.

3. The siderail assembly of claim 1, wherein a portion of the latch pin includes a flat surface.

4. The siderail assembly of claim 1, wherein the latch mechanism also includes a spring coupled to the latch pin, the latch pin being configured to move between a first orientation and a second orientation to prevent a false latch condition, the spring being configured to return the latch pin to the first orientation from the second orientation.

5. A person-support apparatus, comprising:

a frame; and a siderail coupled to the frame and being configured to move between a deployed position and a storage position with respect to the frame, the siderail being selectively maintained in at least one of the deployed position and the storage position by a latch mechanism, the latch mechanism including a latch pin and a pin engaging member, the pin engaging member being configured to engage the latch pin to selectively maintain the siderail in at least one of the deployed position and the storage position, the latch pin being configured to be rotated from a first orientation to a second orientation by the pin engaging member when the pin engaging member does not substantially engage the latch pin.

6. The siderail assembly of claim 5, wherein the latch mechanism also includes a spring coupled to the latch pin and configured to rotate the latch pin from the second orientation when the pin engaging member is disengaged from the pin to the first orientation.

7. The siderail assembly of claim 5, wherein the latch mechanism also includes a stop configured to engage a portion of the latch pin to define the first orientation.

8. The siderail assembly of claim 5, wherein the latch pin engaging member prevents the latch pin from rotating when the pin engaging member substantially engages the latch pin.

9. The siderail assembly of claim 5, wherein the pin engaging member engages a portion of the latch pin having a flat surface.

10. The siderail assembly of claim 5, wherein the pin engaging member engages a portion of the latch pin having a curved surface.

11. The siderail assembly of claim 5, wherein the pin engaging member includes a slot, the pin engaging member does not substantially engage the latch pin unless the latch pin is positioned at a base of the slot.

12. A siderail assembly, comprising:

a siderail base configured to couple the siderail assembly to a frame;

a siderail body;

a movement mechanism coupled to the siderail base and the siderail body and configured to move the siderail body with respect to the siderail base; and a latch mechanism including a first latch member movably coupled to the siderail base and a second latch member movably coupled to the movement mechanism and movable therewith, the second latch member being configured to cooperate with the first latch member to maintain the siderail body in a deployed position, the first latch member being configured to be translated with respect to the siderail base by the second latch member in response to a false latch condition to prevent the siderail body from being maintained in the deployed position.

13. The siderail assembly of claim 12, wherein the latch mechanism also includes a spring coupled to the first latch member and configured to translate the first latch member from a second orientation when the second latch member is disengaged from the first latch member to a first orientation.

14. The siderail assembly of claim 12, wherein the latch mechanism also includes a stop configured to engage a portion of the first latch member to define a first orientation.

15. The siderail assembly of claim 12, wherein the second latch member prevents the first latch member from translating when the second latch member substantially engages the first latch member.

16. The siderail assembly of claim 12, wherein the second latch member engages a portion of the first latch member having a flat surface.

17. The siderail assembly of claim 12, wherein the second latch member engages a portion of the first latch member having a curved surface.

18. The siderail assembly of claim 12, wherein the false latch condition occurs when the second latch member does not substantially engaging the first latch member.

19. The siderail assembly of claim 18, wherein the second latch member includes a slot, the second latch member does not substantially engage the first latch member unless the first latch member is positioned at a base of the slot.

* * * * *